US012799732B2

(12) United States Patent
Gingras

(10) Patent No.: US 12,799,732 B2
(45) Date of Patent: Nov. 17, 2026

(54) INSULATED PANEL CONNECTION

(71) Applicant: SYSTEMES NORBEC INC., Boucherville (CA)

(72) Inventor: Jean-Pierre Gingras, Notre-Dame-de-la-Merci (CA)

( * ) Notice: Subject to any disclaimer, the term of this patent is extended or adjusted under 35 U.S.C. 154(b) by 354 days.

(21) Appl. No.: 18/468,329

(22) Filed: Sep. 15, 2023

(65) Prior Publication Data

US 2024/0093485 A1 Mar. 21, 2024

Related U.S. Application Data

(60) Provisional application No. 63/406,931, filed on Sep. 15, 2022.

(51) Int. Cl.
*E04B 1/38* (2006.01)
*E04B 1/61* (2006.01)
*E04B 1/62* (2006.01)

(52) U.S. Cl.
CPC ..... *E04B 1/6183* (2013.01); *E04B 1/388* (2023.08); *E04B 1/62* (2013.01); *E04B 2001/6195* (2013.01)

(58) Field of Classification Search
CPC ..... E04B 1/388; E04B 1/6183; E04B 1/62; E04B 2001/6195; F16B 5/01; F16B 12/2036
USPC ..... 52/582.2; 403/350
See application file for complete search history.

(56) References Cited

U.S. PATENT DOCUMENTS

| | | | | |
|---|---|---|---|---|
| 854,654 | A | 5/1907 | H. Krantz | |
| 1,129,658 | A | 2/1915 | Foy | |
| 3,304,676 | A | 2/1967 | Sallie et al. | |
| 3,989,397 | A | 11/1976 | Baker | |
| 4,063,393 | A | 12/1977 | Toti | |
| 4,078,847 | A | 3/1978 | Presnick | |
| 4,131,376 | A * | 12/1978 | Busse | F16B 12/2036 403/231 |
| 4,353,663 | A * | 10/1982 | Glickman | F16B 12/20 403/231 |
| 4,385,850 | A | 5/1983 | Bobath | |
| 4,507,815 | A | 4/1985 | Danko | |

(Continued)

OTHER PUBLICATIONS

Corresponding U.S. Appl. No. 18/468,315 Non-Final Rejection mailed Jan. 27, 2026.

*Primary Examiner* — James J Buckle, Jr.
(74) *Attorney, Agent, or Firm* — Anglehart et al.

(57) ABSTRACT

A cam lock for side-by-side tongue-and-groove interlocking panels can be arranged to work easily and effectively by using a keyed cam lock that provides proper orientation and a stop when the lock is engaged. A cam lock for side-by-side tongue-and-groove interlocking panels can be arranged to be inserted on the tongue side and act against a mid-portion of the opposed panel. An insert bracket can cover with one end at least a part of an end of a panel at a corner connection between panels and with the other end it can fit into a slot in the panel to immobilize the panel in two directions, while a fastener-receiving portion of the bracket can have a V-shaped portion whose side walls can guide the fastener to pass through the bracket at a bottom of the V-shaped portion. This concept applies for wall to wall connection, wall to ceiling connection and wall to floor connection.

18 Claims, 10 Drawing Sheets

(56) References Cited

U.S. PATENT DOCUMENTS 4,641,988 A * 2/1987 Ganner ..... F16B 12/2027 52/285.4
4,712,942 A 12/1987 Brown
4,840,440 A 6/1989 Dieter
4,886,326 A * 12/1989 Kuzyk ..... A47B 47/0041 312/263
4,942,713 A * 7/1990 Jackson ..... E04B 2/7425 403/DIG. 12
5,375,923 A * 12/1994 Hall ..... A47B 88/956 312/348.4
5,536,078 A * 7/1996 Novikoff ..... F16B 12/2054 312/265.5
5,567,081 A * 10/1996 Vallance ..... F16B 12/2036 403/231
5,772,353 A * 6/1998 Grieser ..... F16B 12/2036 403/231
5,810,505 A * 9/1998 Henriott ..... F16B 12/14 312/265.5
5,823,700 A * 10/1998 Poworoznek ..... F16B 12/2036 403/245
5,960,598 A 10/1999 Tamlyn
6,341,458 B1 1/2002 Burt
6,758,017 B2 7/2004 Young
6,908,252 B1 * 6/2005 Rubano ..... F16B 12/2027 403/368
6,939,075 B2 * 9/2005 Walz ..... F16B 12/2036 403/231
7,195,436 B1 * 3/2007 Stephen ..... F16B 5/01 411/376
7,223,045 B2 * 5/2007 Migli ..... F16B 12/2009 403/231
D606,672 S 12/2009 Southwell
8,061,105 B2 11/2011 Haga
8,776,376 B2 7/2014 Williams
8,794,864 B2 * 8/2014 Vallance ..... F16B 12/2036 403/DIG. 8
10,215,209 B2 * 2/2019 Lai ..... F16B 12/2036
10,443,635 B2 * 10/2019 Cuddy ..... B64C 1/12
10,858,167 B2 12/2020 D'Anglade
2007/0151197 A1 7/2007 Home
2009/0269130 A1 10/2009 Williams
2009/0293395 A1 12/2009 Porter
2012/0060349 A1 3/2012 Williams
2021/0333042 A1 10/2021 Gingras

* cited by examiner

INSULATED PANEL CONNECTION

CROSS-REFERENCE TO RELATED APPLICATIONS

This patent application shares the same specification and filing date as the patent application Ser. No. 18/468,315.

TECHNICAL FIELD

This patent application relates to insulated panel connectors and to structures built using insulated panels.

BACKGROUND

A common example of insulated panel structures is that of cold storage rooms commonly found in grocery stores. Foam panels having faces covered with thin metal are interconnected to form the wall and the ceiling and floor, if required. While the panels can be custom made with interconnection hardware, metal coated rigid foam panels are also manufactured for use as building siding in a continuous process in which foam is extruded between top and bottom sheets of metal fed out from rolls of sheet metal.

Insulated structures made from such continuous insulated panels are known from Applicant's US patent application publication 2021/0333042. Applicant has found that angled cuts along corners of the insulated panel structure require particular attention and can be difficult to work with. Applicant has also found that side-by-side panel cam locks can require special attention to perform because the cam requires insertion at a particular angular orientation.

SUMMARY

Applicant has found that a keyed cam lock for side-by-side panels can be arranged to work easily and effectively.

Applicant has found that an insert bracket can cover with one end at least a part of an end of a panel at a corner connection and with the other end it can fit into a slot in the panel to immobilize the panel in two directions, while a fastener-receiving portion of the bracket can have a V-shaped portion whose side walls can guide the fastener to pass through the bracket at a bottom of the V-shaped portion. This concept would apply for wall to wall connection, wall to ceiling connection and wall to floor connection.

BRIEF DESCRIPTION OF THE DRAWINGS

The invention will be better understood by way of the following detailed description of embodiments of the invention with reference to the appended drawings, in which.

DETAILED DESCRIPTION

Figure 1A:
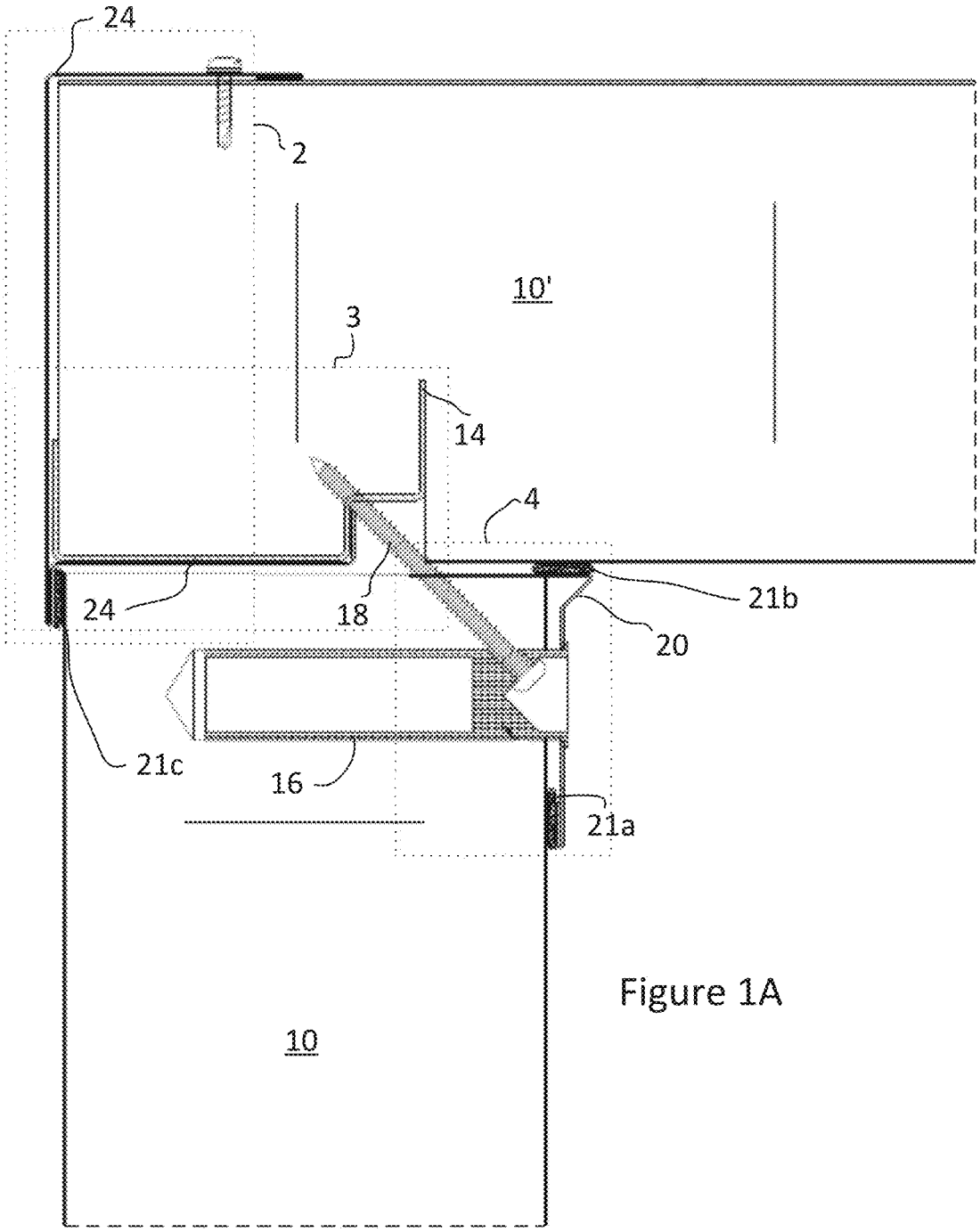
FIG. 1A is a sectional view of a corner connection between two insulated panels illustrating connection hardware according to one embodiment.
Figure 8:
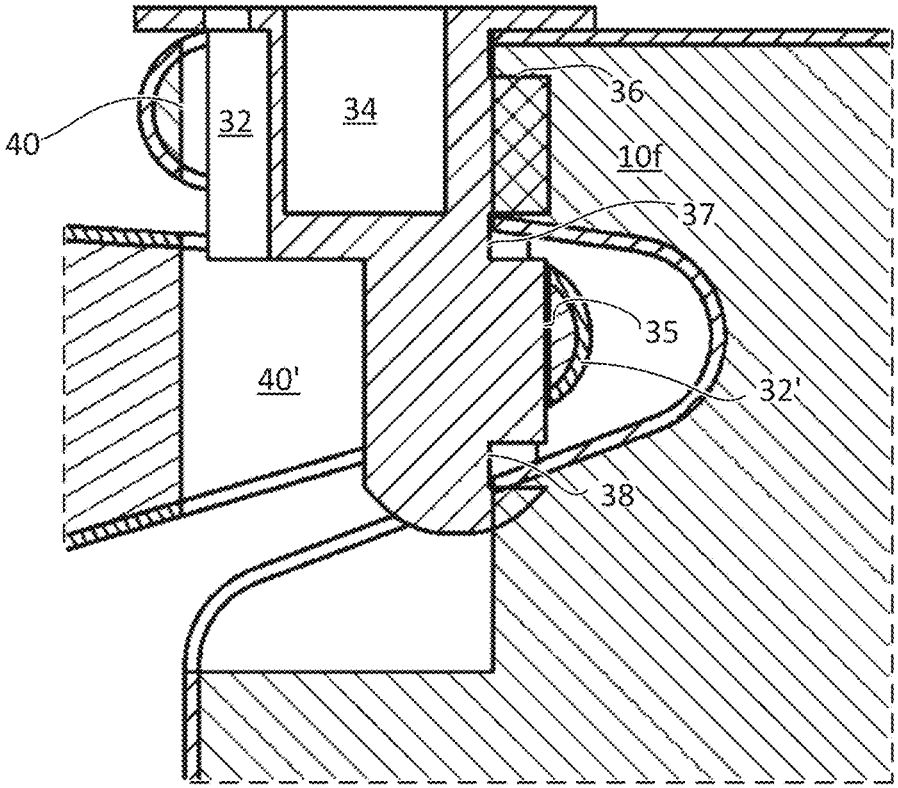
FIG. 8 is a sectional side view of the cam lock of FIG. 5 inserted between two insulated panels in a locked position.

FIG. 1A shows a corner connection between two insulated panels 10 and 10'. The corner may be a vertical or horizontal corner as desired. The panels 10,10' have their adjoining edges at 90 degrees, either because they are cut in this manner or they were manufactured in this way. Continuously formed insulation panels may comprise thin sheet metal surfaces with rigid foam filling the space between the sheet metal sides. Typically, the side edges of a continuously-formed insulation panel has the sheet metal formed to provide a type of tongue and groove interlocking feature as for example is illustrated in FIG. 8. Such an interlocking feature helps maintain a side-by-side alignment between adjacent panels but does not secure two panels together.

Figure 4:
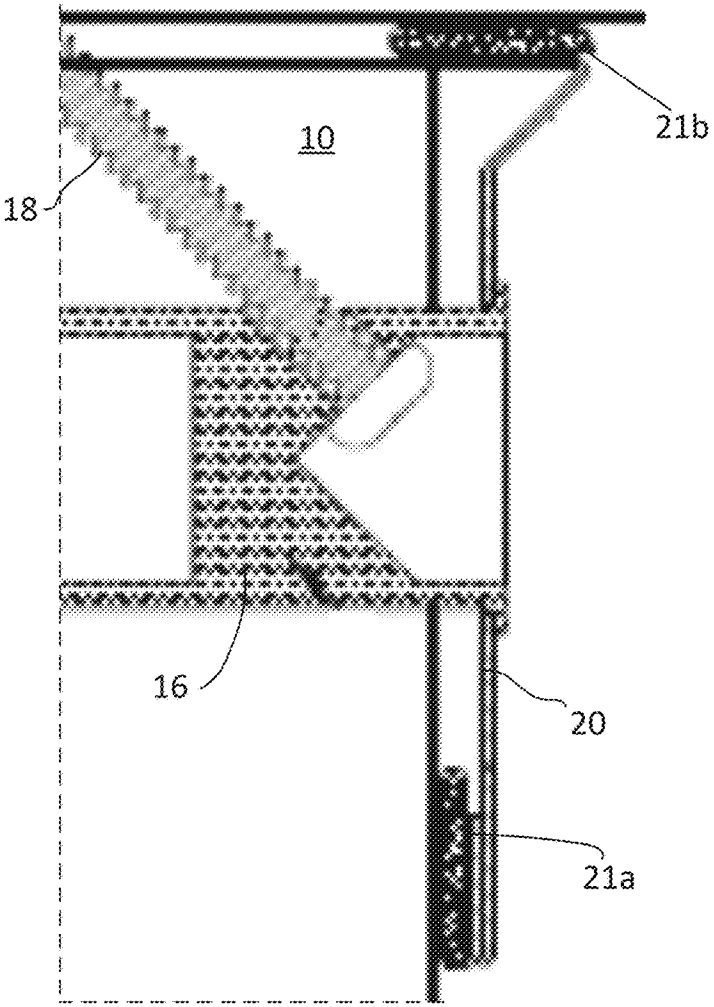
FIG. 4 is a detail of portion 4 of FIG. 1A.

In Applicant's US patent application publication 2021/0333042, at FIGS. 4A and 5A, a corner between two insulated panels is formed by either providing a 45° cut on each panel or by providing a notch and a cut to the panels. The current invention provides a facilitated method of assembly by not requiring the panels to have beveled cuts.

Figure 1B:
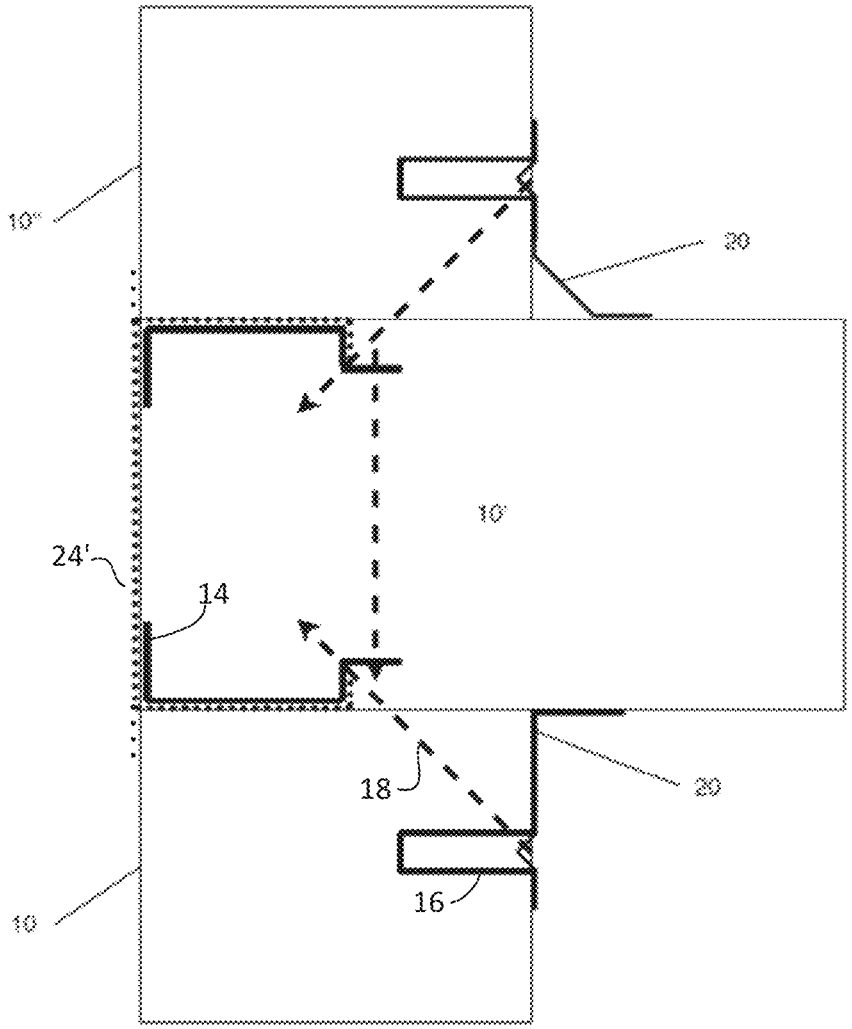
FIG. 1B is a sectional view of a T-type intersection forming two corners between three insulated panels illustrating connection hardware according to one embodiment.

In FIG. 1A, the panels 10 and 10' have no cuts, except for the insert notch. An insert 14 is inset into panel 10'. In the exemplary embodiment, the insert 14 may have three sections: a proximal section extending in a direction of insertion to extend one end of the insert into the panel, that could be glued, for immobilizing the insert within the panel, a distal section extending perpendicular to the proximal section, possibly having a subsection for running along an outside of the panel and a subsection bent in the direction of insertion to wrap around the end of the panel for providing grip or friction to the insert relative to the panel or otherwise immobilize the insert on the panel, or provide additional sealing around the end of the panel, and a middle section between the proximal section and the distal sections, formed by at least one bend, forming a guiding section that can facilitate fastening of the insert to other inserts or structures by guiding a fastener into a desired part of the insert. In the exemplary embodiment of FIGS. 1 and 2, the middle section of the insert is formed by having three bends resembling a W, where a middle part of the W facilitates the fastening of the insert to other inserts or structures by guiding fasteners into an inner angle of the W, such that walls of the W can push the fastener toward the inner angle, and where the W structure provides strength to the insert if the fastening experiences strain. It is possible for the middle section to take on other shapes, including a series of bends forming a new protrusion that could extend into the foam of panel 10, where the protrusion forms a 90 degree angle which can guide a fastener to the corner of said 90 degree angle.

An orifice or slot 15 can be cut through the metal skin 12 into panel 10' to provide the desired shape for receiving the proximal end of the insert 14. Such an orifice may have a different shape, depending on the shape of the insert.

Figure 1C:
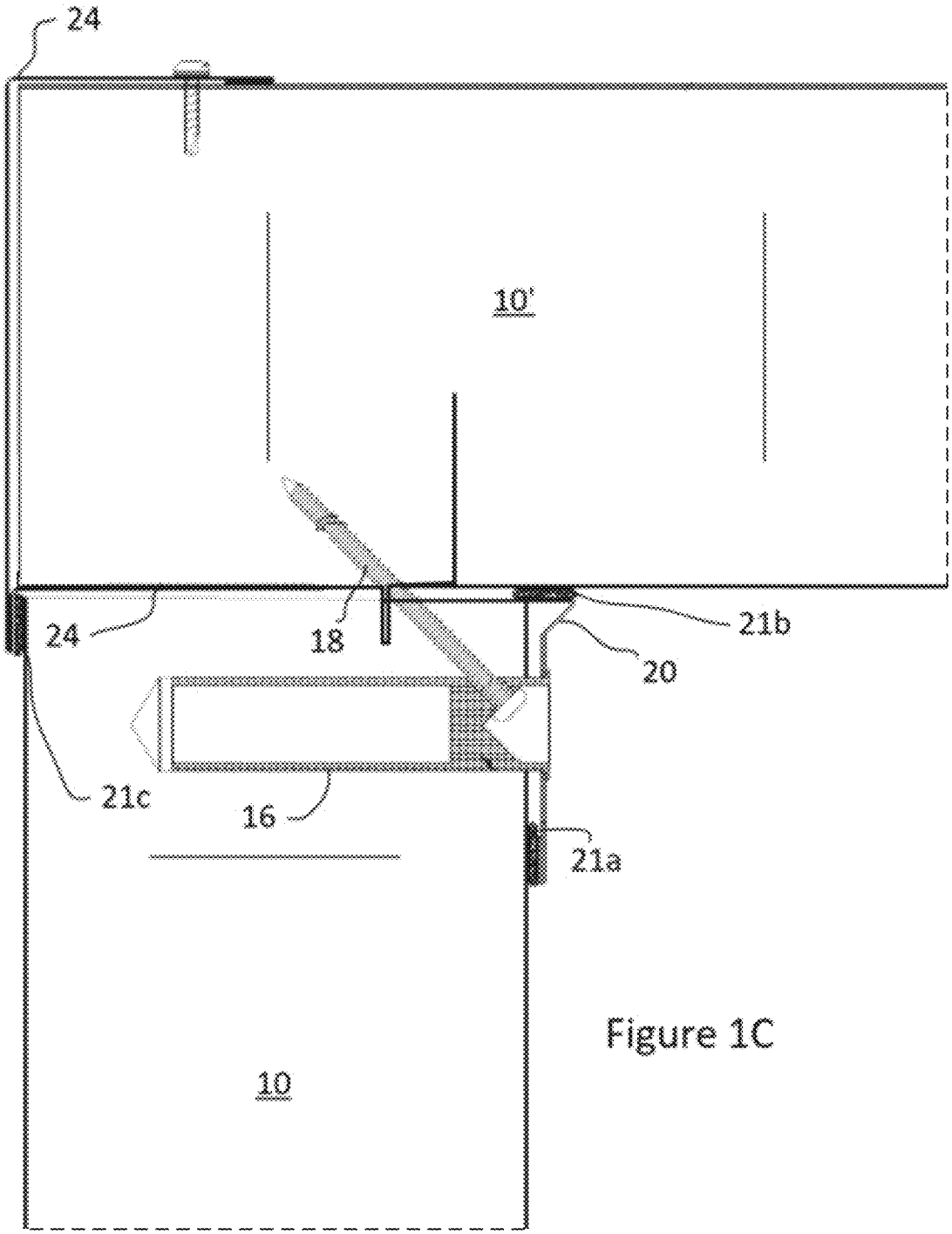
FIG. 1C is a sectional view of a corner connection between two insulated panels illustrating connection hardware according to an embodiment different from that of FIG. 1A.
Figure 2:
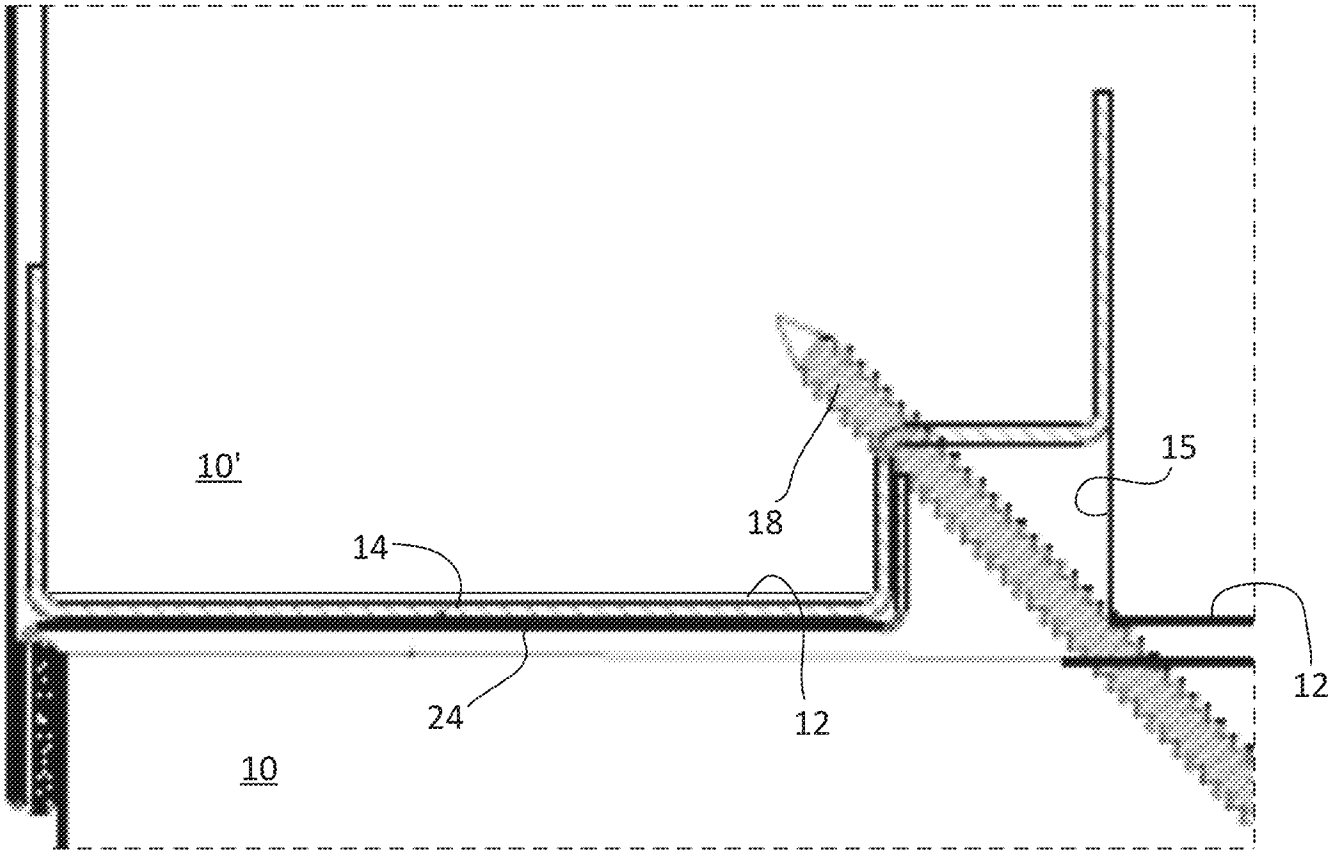
FIG. 2 is a detail of portion 2 of FIG. 1A.

In the variant illustrated in FIG. 1C, a single insert is illustrated that provides a V-shaped portion extending into panel 10 for receiving the fastener 18. A proximal flange may extend into a slot within panel 10'. A hairpin turn may cover a gasket 21*c* to provide a stop. The insert 24 may then continue and cover the end of panel 10' before wrapping around and attaching to an outer side of panel 10'.

Turning back to FIG. 1A, insert 14 is used to connect panel 10' to panel 10. While an elongated insert having one or more flanges could be inset in panel 10, in the embodiment of FIGS. 1 and 4, cylindrical inserts 16 can be inserted into drilled holes in panel 10 at desired positions and can be used along with fasteners 18 to connect panel 10 to panel 10'. When the fasteners 18 are self-tapping screws or otherwise are able to pierce the insert 14, pilot holes in insert 14 are not required. The insert 14 is illustrated as having a guiding section, the inner angle of the W shaped bend, where the fastener 18 connects. This can facilitate making pilot holes or guiding the fastener 18 as it pierces the insert 14 and strengthen the insert 14 as the fasteners 18 pull on it. The guiding section could also be a beveled edge so as to present a surface perpendicular to the fastener 18. As detailed in FIG. 4, the inserts 16 can hold in place an inside corner sealing flange 20 having gaskets 21*a* and 21*b*. A 45° corner section in flange 20 is shown and may be used to facilitate cleaning of the inside corner.

Alternatively, other shapes of corner flanges may be outfitted for inserts near corners, depending on the desire or need of the user. For example, as illustrated in FIG. 1B, the corner section 20 may, instead of the 45° angle, have a right angle and thus be entirely flush with the corner. In this embodiment, the T-junction has two corners, one with a 45° angle (the upper one illustrated) and one with a right angle (the lower one illustrated). The choice of the shape of the corner sections is based on the preferences of the user.

Figure 3:
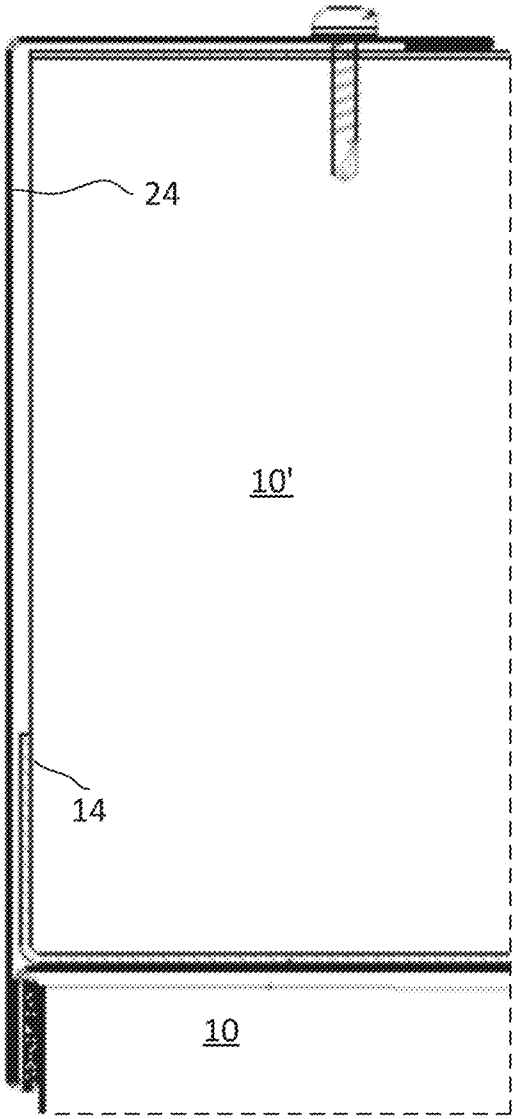
FIG. 3 is a detail of portion 3 of FIG. 1A.

As shown in FIG. 1A, a C-shaped bracket 24 may be placed over the end of panel 10'. The bracket 24 may be secured to the panel 10' using adhesive and/or fasteners, as for example a screw fastener at the top of FIGS. 1 and 3 extending through the metal skin into the foam of panel 10'. While the bracket 24 is shown as being separate from insert 14, it will be appreciated that it could be integrated into one part. For sealing purposes, bracket 24 may include a hairpin fold (or other extension) and a gasket 21*c* for sealing the edge of panel 10 against panel 10' on the outside. In addition to allowing for the placement of the gasket 21*c*, the hairpin fold may act as a stopper or abutment to prevent panel 10' from shifting when fastening to panel 10 with screw 18.

In the embodiment of FIG. 1B, the bracket 24' may cover the foam-exposed end of panel 10' and may have hairpin folds extending onto panels 10 and 10". These hairpin folds (or any suitable extensions) may act as stoppers or abutments to prevent relative movement between the panels when connected.

In some embodiments, a number of additional fasteners may be used for strengthening the corner connection or sealing capabilities of the corner connection. For example, a fastener may be used to fasten bracket 24 by inserting a fastener through the hairpin fold and the metal skin of panel 10. In another example, a fastener may be inserted through bracket 24 and insert 14 to fasten the bracket and insert together.

In some embodiments, stamped recesses may be used to created small spaces where the fasteners are to be inserted, so that the extremities of the fasteners (e.g., the head of a screw) do not leave protrusions above the metal skin of the panels after fastening. Instead, the extremities may fit within the stamped recesses and be flush with the metal skin of the panel they are inserted in.

Although the above describes a corner joint where two insulated panels are joined together to form a corner, the system may also be used for a T-type intersection of panels involving three panels, where each inner corner in the T is itself a corner. This is illustrated in FIG. 1B. In the exemplary embodiment of FIG. 1B, three insulated panels 10, 10' and 10' come together to form a T-type intersection. Panel 10' is the panel forming the outer side of the corner. The two corners formed by the T-type intersection may be additionally secured by a fastener 18 that connects the inserts of both corners on the insulated panel forming the outer side of the corner (see the vertical fastener in FIG. 1B). This would provide stability to the T-type intersection. The bracket 24 that is added to the insulated panel forming the outer side of the corner may also be adapted to be better suited to the T-type intersection. For example, it may be designed to interface with and support inserts on both sides of the insulated panel forming the outer side of the corner by fully wrapping around both sides of the insulated panel (as shown in FIG. 1B). It should be noted that FIG. 1B was illustrated with readability in mind. As such, the bracket is drawn almost as if coming out from the left of panel 10', and the inserts are drawn somewhat to the inside of panel 10'. In a real application, the bracket 24 and inserts 14 may be placed one on top of another and may be thin enough to effectively be flush with the metal skin of panel 10', so that the panel 10' retains its rectangular shape. In some embodiments, the metal skin of panel 10' may be removed at its end to make room for the bracket or inserts to be truly flush with the metal skin of panel 10'. Note that though gaskets are not illustrated in FIG. 1B, in some embodiments, gaskets may be included around the flanges near the cylindrical inserts or held by the bracket 24.

Figure 1D:
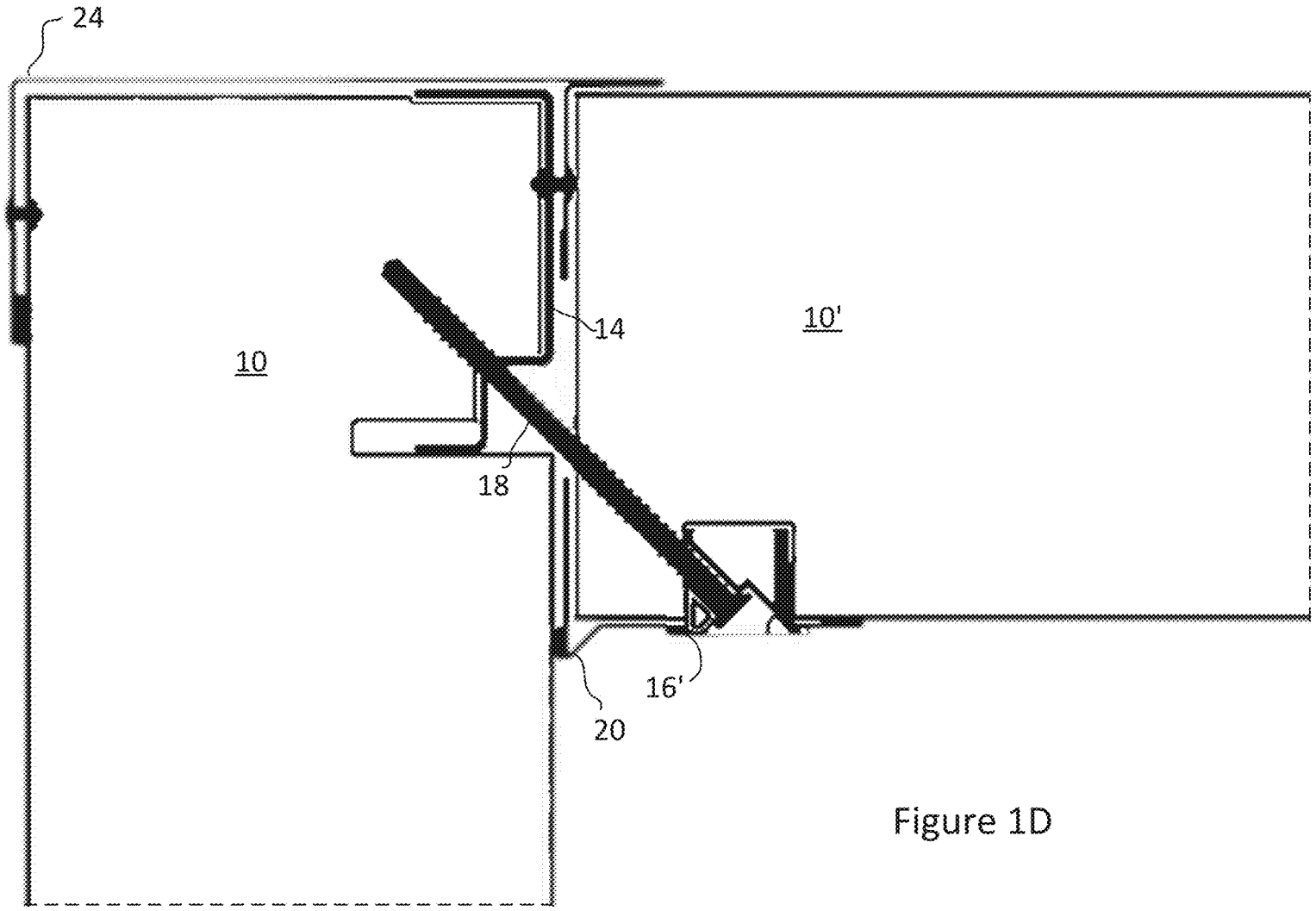
FIG. 1D is a sectional view of a corner connection between two insulated panels illustrating connection hardware according to another embodiment different from that of FIG. 1A.

In the embodiment illustrated in FIG. 1D, the corner is formed by having the inside surface of panel 10 covered by the end of panel 10'. Bracket 14 covers the inside surface into which a groove or notch is formed. A bracket 24 is attached to the panel 10 to cover its exposed end, and as illustrated it may cover the abutting end of panel 10' and may connect to bracket 14. Insert 16' may be cylindrical and shorter in length than insert 16 while providing a support for the head of the fastener 18 to connect to the insert bracket 14. Flange 20 can cover the inside corner and be held in place by the insert 16'. The inserts 16 and 16' are illustrated in the sectional views as being cylindrical, thus allowing them to be inserted into a cylindrical hole made in the panel 10 or 10'. However, inserts 16 or 16' can have any shape to match the hole. As shown in FIG. 1F, the insert 16' has a shape that can be made by a central hole and two or three orientation holes so that the insert will have a fixed orientation when inserted.

Figure 1E:
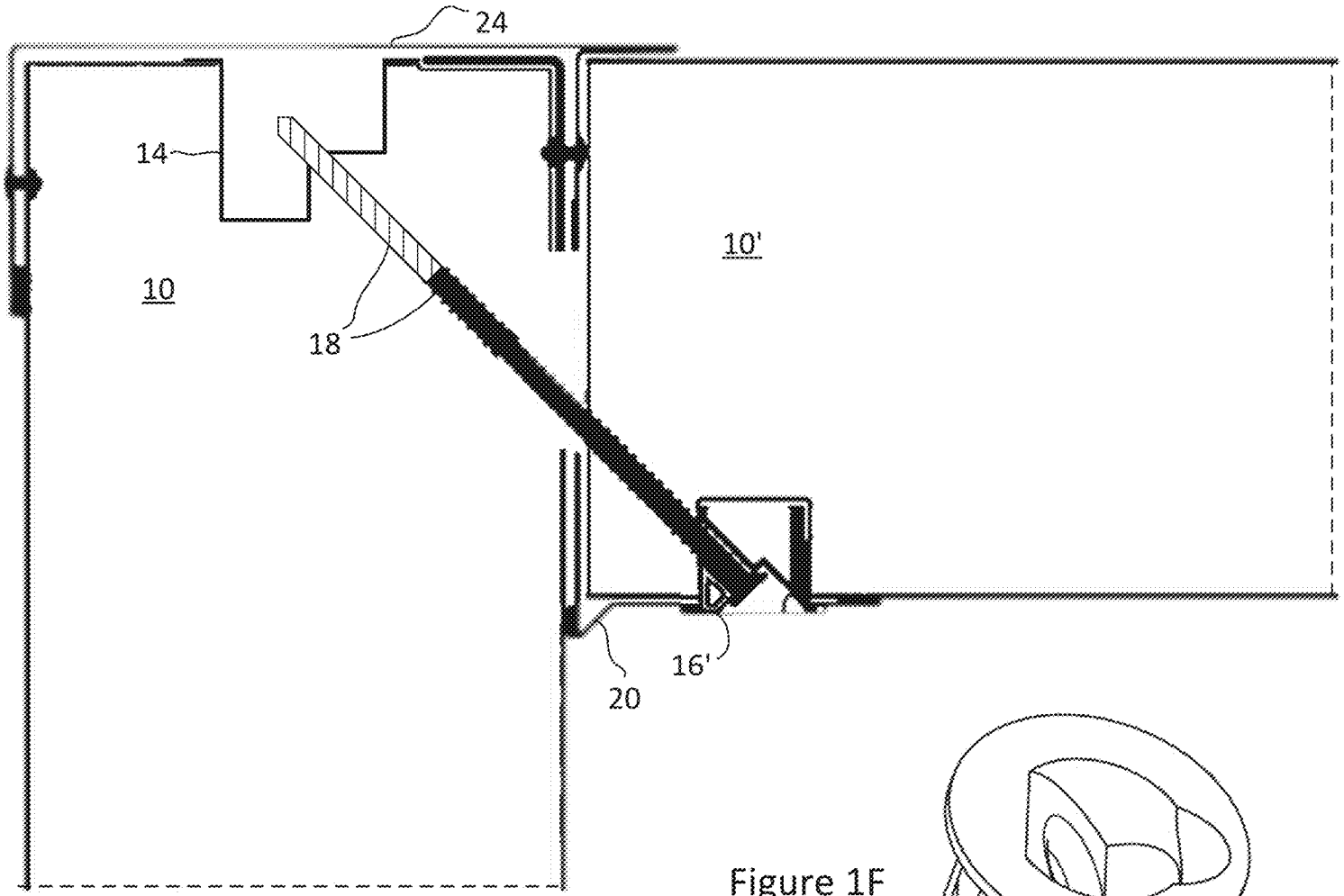
FIG. 1E is a sectional view of a corner connection between two insulated panels illustrating connection hardware according to a further embodiment different from that of FIG. 1A.
Figure 1F:
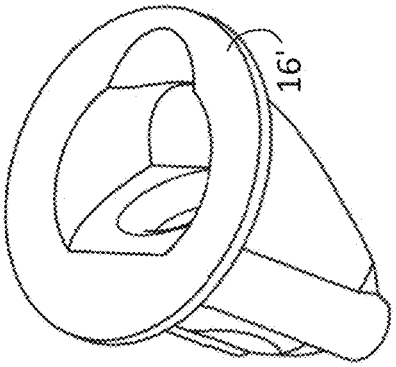
FIG. 1F is an isometric view of an insert shown in FIG. 1E.

Alternatively, in the embodiment shown in FIG. 1E, the rail bracket 14 may be inserted into the exposed end of panel 10 and present a concave angled surface for receiving the fastener 18. It will be appreciated that the shape of the insert rail bracket can be similar to that in FIG. 1C (the left wall of the channel in FIG. 1E can be moved to join the concave angled surface making the channel narrower). In this embodiment, the inside lateral side of panel 10 need not be notched or grooved, and the fastener may pass through the metal skin until it reaches the bracket 14. Furthermore, the bracket 24 can be connected or integrated with the insert bracket 14 and reduce the number of steps during assembly.

Figure 5:
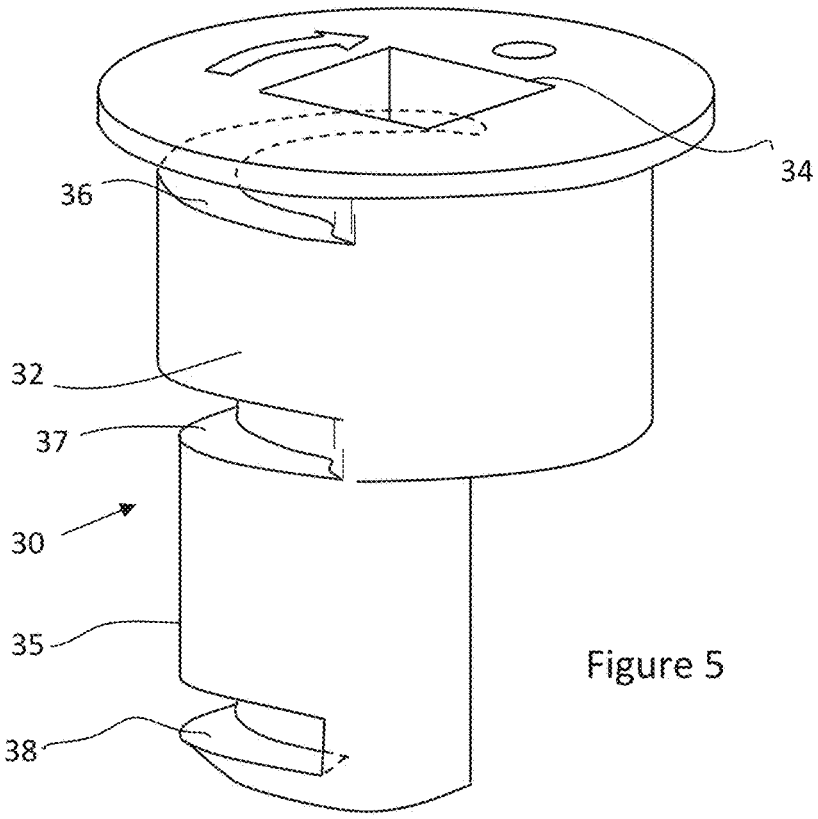
FIG. 5 is an oblique view of a shaped cam lock according to one embodiment.
Figure 6:
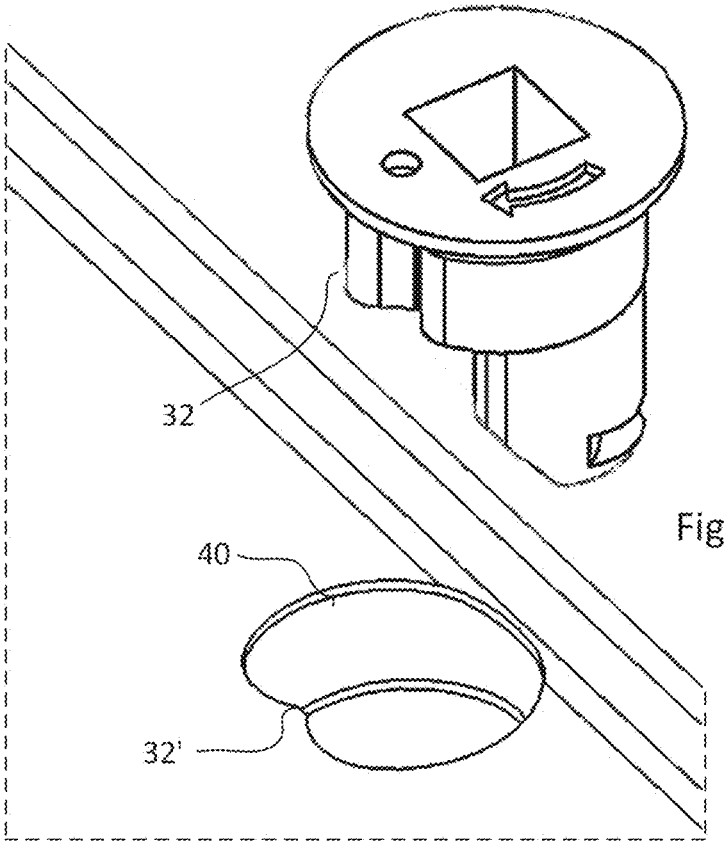
FIG. 6 shows a shaped aperture and an aligned cam lock.

FIG. 5 illustrates a cam lock 30 having a key 32. The cam lock 30 functions in a manner similar to the cam lock illustrated in FIGS. 2A and 2B of Applicant's US patent application publication 2021/0333042, however, the cam lock 30 is keyed (see key indentation 32) to require inserting into a hole 40 in a panel having a corresponding protrusion 32' in a given rotational position as shown in FIG. 6. While the keying involves an indentation 32 in the embodiment of FIG. 5, it will be appreciated that a protrusion can also be used.

In the embodiment of FIG. 5, two recesses 36 and 37 are provided on one side of the indentation 32 to allow clockwise rotation only and to provide a rotation limit at the position where the cam pulls the most. The direction of rotation is chosen in this embodiment to be clockwise as it is the conventional direction of fastening, however, it could also be chosen to be counter-clockwise.

Figure 7:
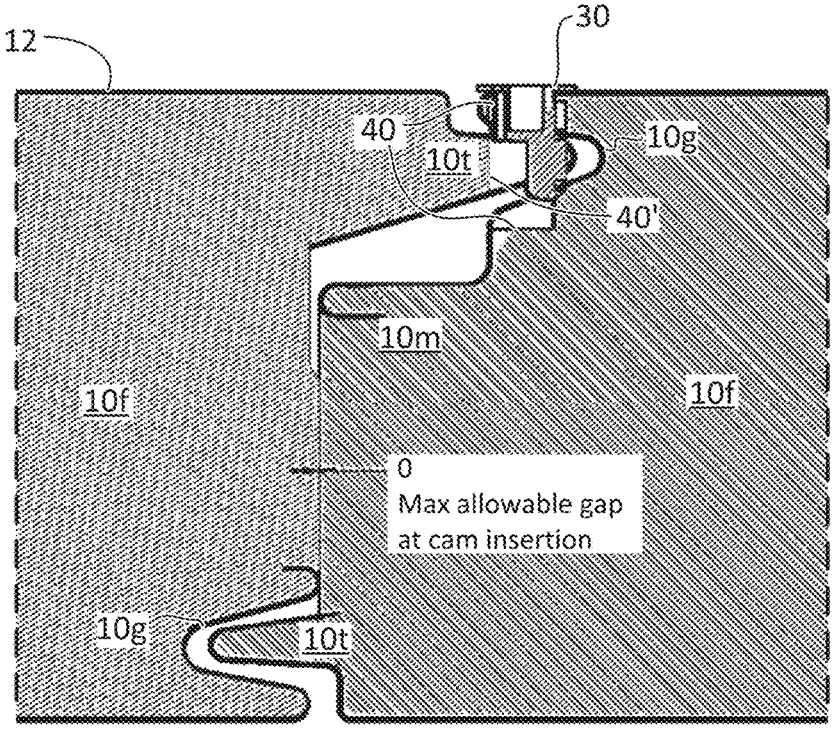
FIG. 7 is a sectional side view similar to FIG. 6 showing a full width of two interconnected insulated panels.

As shown in FIG. 7, the insulated panels may have tongue and groove mating portions, for example in a symmetrical manner with opposed tongue 10*t* and groove 10*g* portions in metal skin 12 arranged in the so-called Z-panel arrangement. The hole 40 can be punched out or machined out from the one panel, while hole 40' can be punched out or machined out from the other opposed panel. The two panels can be abutted as shown with the foam 10*f* in contact.

The cam lock 30 may be inserted into the holes 40 and 40' in the position shown in FIG. 6 and then it may be turned 180° by inserting a tool into aperture 34 to be in the position shown in FIG. 7 and as detailed in FIG. 8. This rotation causes surface 35 to press against the metal surface of aperture 40' while the upper part of cam lock 30 engages the metal rim of aperture 40. The upper part of the cam lock 30 between grooves 36 and 37 can crush into the foam 10*f* on one side of aperture 40 as shown in FIG. 8. This can provide a friction hold on the final position of the cam lock 30 in addition to the cam action. Grooves 36, 37 and 38 may also prevent the cam lock 30 from being pulled out of the apertures 40, 40' by engaging in the protrusion 32' of the metal skins 12 of the panels.

Figure 9:
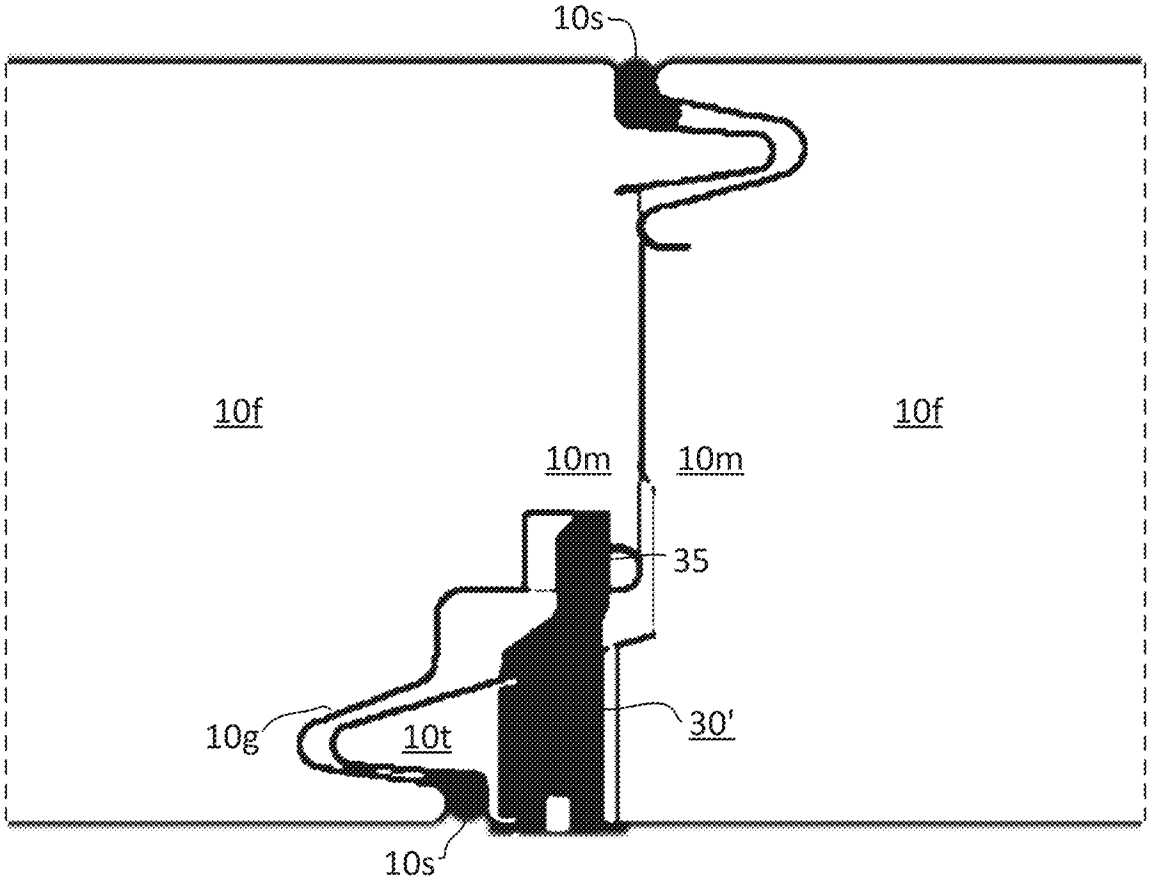
FIG. 9 is a sectional side view of an alternative embodiment in which the cam lock is insert into a side of an insulated panel before its tongue with the cam end engaging an aperture of a mid-portion of the opposed insulated panel.

As will be appreciated, the Z-panels illustrated in FIG. 7 have differently sized tongues 10*t* and grooves 10*g*. On the side in which the cam 30 is inserted, the tongue portion 10*t* can extend more than the opposed side's tongue 10*t* and a mid-portion 10*m* can be provided (on the right panel 10*f* in FIG. 7, while the tongue 10*t* (of the left panel 10*f* in FIG. 7) overhangs the mid-portion 10*m*. In the embodiment of FIG. 9, the cam lock 30' is insert into a side of an insulated panel 10*f* before its tongue 10*t* with the cam end 35 engaging an aperture of a mid-portion 10*m* of the opposed insulated panel 10*f*. The aperture being in a side of the mid-portion 10*m* that is covered by the metal sheet or skin of the panel allows for a good engagement surface for cam end 35. Rotation of the cam 30' causes the mid-portions 10*m* to move into contact with each other. A sealant 10*s* can be applied to seal the lateral side surfaces of the panels 10*f*.

Figure 10:
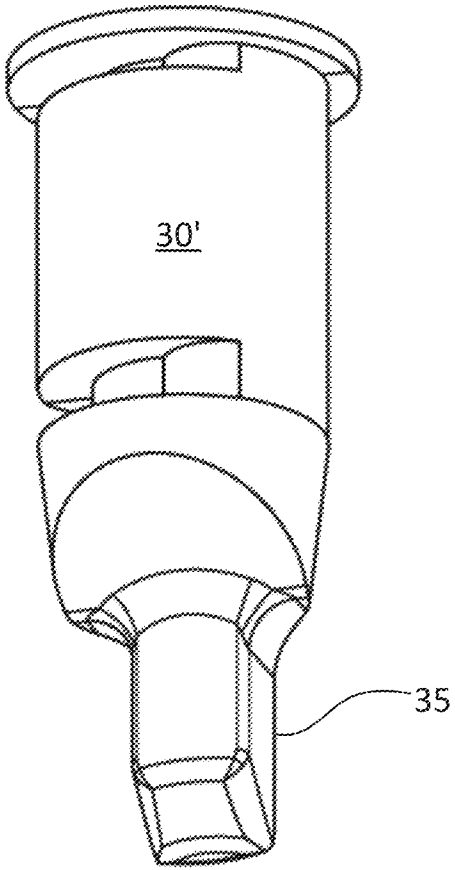
FIG. 10 is an isometric view of a cam lock as shown in FIG. 9.

The shape of the cam lock 30' is shown in FIG. 10.

As will be understood, the cam 30' is longer than the cam 30, and its specific shape may or may not have the features described with reference to FIG. 5, namely it may be configured for being locked by turning in one direction only, or it may be shaped in a manner similar to that described in Applicant's US patent application publication 2021/0333042.

What is claimed is:

1. A cam lock for locking in place a tongue and groove edge connection between first and second insulated panels comprising insulated foam sandwiched between sheeting material, comprising:

a. a cylindrical body having a key formed from at least one of a protrusion and an indentation that gives the cam lock a distinct shape that is complementary to the shape of a hole in which the cam lock can be inserted, thereby ensuring that the cam lock can only be inserted in the hole and subsequently twisted in a clockwise or counter-clockwise intended direction up to a rotation limit;

b. an upper section of the cylindrical body formed by a flange parallel to the insulated panels that extends away from the cylindrical body and an aperture in which a tool can be inserted to enable twisting of the cam lock using said tool;

c. a recess of gradual indentation below the flange that aligns with the sheeting material of a first of the insulated panels surrounding said hole and, via the gradual indentation, permits the rotation of the cam lock in only the clockwise or counter-clockwise direction up to a rotation limit;

d. a section below the recess forming a protrusion that, when the cam lock is twisted into place, crushes into the insulated foam of the first insulated panel to obtain a further frictional hold on the final position of the cam lock; and e. a lower section forming a cam surface protrusion that is excentric on said cylindrical body and that, as the cam lock is twisted into place, pushes on the sheeting material of a second of the insulated panels to bring said second insulated panel in close connection with said first insulated panel.

2. The cam lock of claim 1, further comprising one or two additional recesses that align with the tongue and groove edge connection between the insulated panes, preventing the cam lock from being pulled out of the hole by engaging the sheeting material of the insulated panels.

3. The cam lock of claim 1, wherein the section forming the protrusion comprises a substantially cylindrical shape extending away from and substantially parallel to a rotation axis of the cam lock and is for insertion through the sheeting material of the second insulated panel, wherein said substantially cylindrical shaped section has a radius smaller than the cylindrical body and has a central axis off-centered from a central axis of the cylindrical body to provide linear motion by pushing the sheeting material of the second insulated panel away from said rotation axis, when said cam lock is rotated in said clockwise or counter-clockwise intended direction so that said sheeting material of the second insulated panel is engaged by said substantially cylindrical shaped section.

4. The cam lock of claim 3, wherein the substantially cylindrical shaped section forming the protrusion is for insertion through a tongue or a groove of the second insulated panel.

5. The cam lock of claim 4, wherein the substantially cylindrical shaped section comprises one of said recess of gradual indentation that aligns with a sheeting material of a groove or tongue of first insulated panel.

6. The cam lock of claim 1, wherein said complementarily shaped hole extends through a tongue of the first insulated panel, wherein the cylindrical body has a length greater than a length of said complementarily shaped hole and short enough for the section forming the protrusion to be the only part of the cam lock that reaches said sheeting material of the second insulated panel.

7. The cam lock of claim 1, wherein the section forming the protrusion comprises a substantially cylindrical shape extending away from and substantially parallel to a rotation axis of the cam lock and is for insertion through the sheeting material of the second insulated panel, wherein said substantially cylindrical shaped section has a radius smaller than the page 4 of 9 cylindrical body and has a central axis off-centered from a central axis of the cylindrical body to provide linear motion by pushing the sheeting material of the second insulated panel away from said rotation axis, when said cam lock is rotated in said clockwise or counter-clockwise intended direction so that said sheeting material of the second insulated panel is engaged by said substantially cylindrical shaped section.

8. The cam lock of claim 7, wherein the substantially cylindrical shaped section forming the protrusion is for insertion through a tongue or a groove of said tongue and groove interlocking features of the second insulated panel.

9. The cam lock of claim 8, wherein the substantially cylindrical shaped section comprises one of said recess of gradual indentation that aligns with a sheeting material of said tongue or said groove of first insulated panel.

10. The cam lock of claim 1, wherein said complementarily shaped hole extends through a tongue of the first insulated panel, wherein the cylindrical body has a length greater than a length of said complementarily shaped hole and short enough for the section forming the protrusion to be the only part of the cam lock that reaches said sheeting material of the second insulated panel.

11. The cam lock of claim 1, wherein the section forming the protrusion comprises a substantially cylindrical shape extending away from and substantially parallel to a rotation axis of the cam lock and for insertion through the sheeting material of the second insulated panel, wherein said substantially cylindrical shaped section has a radius smaller than the cylindrical body and has a central axis off-centered from a central axis of the cylindrical body to provide linear motion by pushing the sheeting material of the second insulated panel away from said rotation axis, when said cam lock is rotated in said clockwise or counter-clockwise intended direction so that said sheeting material of the second insulated panel is engaged by said substantially cylindrical shaped section.

12. The cam lock of claim 11, wherein the substantially cylindrical shaped section forming the protrusion is for insertion through said tongue or said groove of the second insulated panel.

13. The cam lock of claim 12, wherein the substantially cylindrical shaped section comprises one of said recess of gradual indentation that aligns with a sheeting material of said groove or said tongue or the first insulated panel.

14. The cam lock of claim 9, wherein said hole of the first insulated panel is a keyed hole extending through said tongue of the first insulated panel, wherein the cylindrical body has a length greater than a length of said keyed hole and short enough for the section forming the protrusion to be the only part of the cam lock that reaches said sheeting material of an inner wall of said groove of the second insulated panel.

15. A system for forming a connection between two insulated panels by locking in place said insulated panels, the system comprising:

said two insulated panels, each of the insulated panels comprising:

insulation foam sandwiched between sheeting material;

a tongue and groove alignment structure, wherein the tongue of the alignment structure of a first of the two insulated panels is insertable in the groove of the alignment structure of a second of the two insulated panels for aligning the two insulated panels when forming said connection;

a hole through the sheeting material and in the insulation foam for receiving part of cam lock; and said cam lock for locking in place the two insulated panels, the cam lock comprising:

a. a cylindrical body having a key formed from at least one of a protrusion and an indentation that gives the keyed cam lock a distinct shape that is complementary to the keyed hole, thereby ensuring that only the keyed cam lock is insertable in the keyed hole and subsequently twisted in a clockwise or counter-clockwise intended direction up to a rotation limit;

b. an upper section of the cylindrical body formed by a flange parallel to the insulated panels that extends away from the cylindrical body and an aperture in which a tool can be inserted to enable twisting of the keyed cam lock using said tool;

c. a recess of gradual indentation below the flange that aligns with the sheeting material of a first of the insulated panels surrounding said hole and, via the gradual indentation, permits the rotation of the cam lock in only the clockwise or counter-clockwise direction up to a rotation limit;

d. a section below the recess forming a protrusion that, when the cam lock is twisted into place, crushes into insulated foam of the first insulated panel to obtain a further frictional hold on the final position of the cam lock; and e. a lower section forming a cam surface protrusion that is excentric on said cylindrical body and that, as the cam lock is twisted into place, pushes on the sheeting material of a second of the insulated panels to bring said second insulated panel in close connection with said first insulated panel.

16. A method for forming a connection between insulated panels involving a keyed cam lock, the method comprising:

a. obtaining insulated panels comprising insulated foam sandwiched between sheeting material and tongue and groove interlocking features;

b. if the insulated panels do not already contain a keyed hole, creating a keyed hole in the insulated panels above the interlocking features that is complementary to the keyed structure of a keyed cam lock, wherein the keyed cam lock comprises:

1. a cylindrical body having a key formed from at least one of a protrusion and an indentation that gives the keyed cam lock a distinct shape that is complementary to the keyed hole, thereby ensuring that only the keyed cam lock is insertable in the keyed hole and subsequently twisted in a clockwise or counter-clockwise intended direction up to a rotation limit;

2. an upper section of the cylindrical body formed by a flange parallel to the insulated panels that extends away from the cylindrical body and an aperture in which a tool can be inserted to enable twisting of the keyed cam lock using said tool;

3. a recess of gradual indentation below the flange that aligns with the sheeting material of a first of the insulated panels surrounding said hole and, via the gradual indentation, permits the rotation of the keyed cam lock in only the clockwise or counter-clockwise direction up to a rotation limit;
4. a section below the recess forming a protrusion that, when the keyed cam lock is twisted into place, crushes into insulated foam of the first insulated panel to obtain a further frictional hold on the final position of the keyed cam lock; and
5. a lower section forming a cam surface protrusion that is excentric on said cylindrical body and that, as the keyed cam lock is twisted into place, pushes on the sheeting material of a second of the insulated panels to bring said second insulated panel in close connection with said first insulated panel;

c. pushing the insulated panels together, side by side, to cause the tongue and groove features to interconnect;

d. inserting the keyed cam lock into the complementary keyed hole to ensure that the keyed cam lock is inserted in said clockwise or counter-clockwise intended direction; and e. twisting the keyed cam lock, using a tool, in the intended direction, up to the rotation limit, forcing the keyed cam lock to lock the tongue and groove features in place, immobilizing and aligning the insulated panels.

17. The method of claim 16, wherein the recess of the keyed cam lock further determines the rotation limit of the keyed cam lock, a second and third recess to control the position and anchor the keyed cam lock within the insulated panels.

18. The method of claim 16, wherein creating a keyed hole that is complementary to a keyed structure of the cam lock is done via specialized machinery provided by the manufacturer of the inserts or insulated panels.

* * * * *